US005392848A

United States Patent [19]

Böttcher et al.

[11] Patent Number: 5,392,848

[45] Date of Patent: Feb. 28, 1995

[54] HEAT EXCHANGER MODULE

[75] Inventors: Jürgen Böttcher, Eckental-Eschenau; Rudolf Ganz, Lauf; Jürgen Heinrich, Selb; Otto Heinz, Neu-Isenburg; Rüdiger Herrimann, Münchberg, all of Germany; Heinrich Schelter, deceased, late of Selb, Germany, by Sibylle Schelter, néLöffler, heiress; Matthias Simmerl, Leupoldsgrün, Germany

[73] Assignee: Hoechst Aktiengesellschaft, Frankfurt am Main, Germany

[21] Appl. No.: 65,179

[22] Filed: May 20, 1993

[30] Foreign Application Priority Data

May 23, 1992 [DE] Germany ..... 4217193

[51] Int. Cl.[6] ..... F28F 7/02

[52] U.S. Cl. ..... 165/164; 165/167

[58] Field of Search ..... 165/164–167

[56] References Cited

U.S. PATENT DOCUMENTS

| | | | |
|---|---|---|---|
| 4,102,632 | 7/1978 | Hastings | 432/3 |
| 4,368,779 | 1/1983 | Rojey et al. | 165/165 |
| 5,099,915 | 3/1992 | Van Dyke | 165/156 |

FOREIGN PATENT DOCUMENTS

| | | |
|---|---|---|
| 0077656 | 4/1983 | European Pat. Off. . |
| 2152729 | 4/1973 | France . |
| 3643750 | 6/1988 | Germany . |

*Primary Examiner*—Allen J. Flanigan

*Attorney, Agent, or Firm*—Curtis, Morris & Safford

[57] ABSTRACT

In the heat exchanger module, produced by stacking sheet cards provided with openings and subsequently joining the individual cards of the card stack, each sheet card (2) or group of sheet cards of the stack is arranged rotated about a common axis by an angle α of between 0° and 30° with respect to the preceding sheet card (2) or group of sheet cards, the openings (3) forming helical channels (4).

3 Claims, 2 Drawing Sheets

HEAT EXCHANGER MODULE

The invention relates to a heat exchanger module produced by stacking sheet cards provided with openings and subsequently joining the individual cards of the card stack.

In the following, sheet cards are understood to mean cards made of green ceramic, of metal such as, for example, alloys of copper, of steel, of aluminum or of plastic and joining is understood to mean laminating with subsequent firing, soldering, welding, adhesion bonding or mechanical joining with the interposition of seals.

Heat exchanger modules of the aforementioned type are known from DE-A-36 43 750. The ceramic sheet cards from which the known heat exchanger modules are made have first apertures, which, when the cards are stacked, form continuous channels. Second apertures are arranged around the first apertures in such a manner that two of the apertures of adjacent cards partly overlap one another, forming channels which run perpendicularly to the continuous channels and surround the latter. The high flow resistance in the channels formed by the second apertures is disadvantageous. The invention intends to remedy this.

The object is achieved by a heat exchanger module of the type described at the outset which is characterized in that each sheet card or group of sheet cards of the stack is arranged rotated about a common axis by an angle $\alpha$ of between 0° and 30° with respect to the preceding sheet card or group of sheet cards, the openings forming helical channels.

The sheet cards can be circular in design and have, concentrically to their contour, circular segments, in particular two circular segments arranged symmetrically to one another, as openings.

The advantages achieved by the invention can be seen essentially in the reduction of the flow resistance. Furthermore, the module can be built up from one card pattern without turning the card. Heat exchanger modules of this type, because of their good adaptability even to widely varying volume flows, are suitable for use for liquid/liquid, liquid/gas and gas/gas heat exchange and for condensation and evaporation processes even at high pressures and with the use of highly corrosive media. The heat exchanger module is used in motor vehicles of all kinds, ships, aircraft and rail vehicles.

The invention is explained in greater detail below with the aid of drawings showing only one embodiment.

Figure 1:
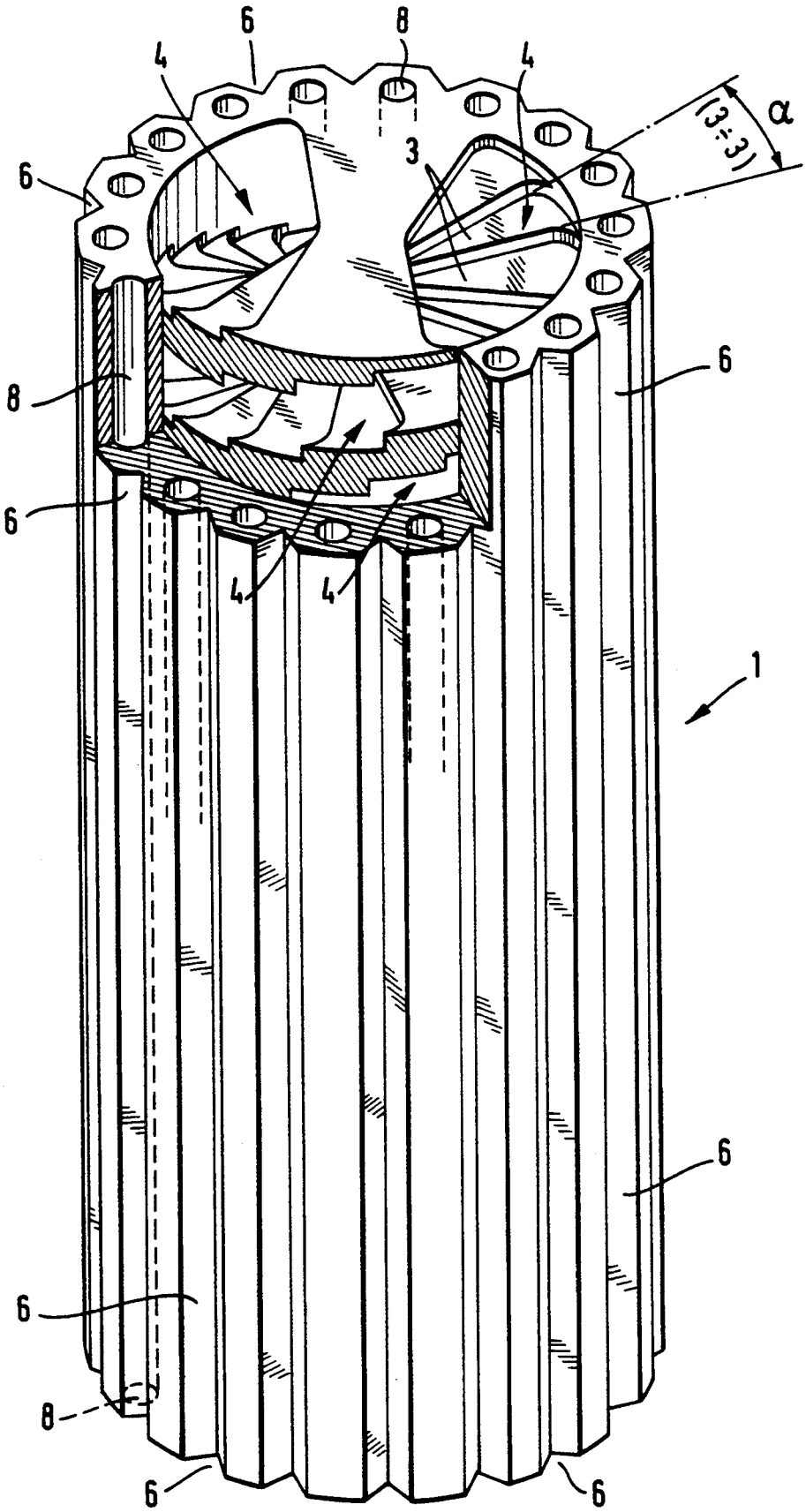
FIG. 1 shows a three-dimensional view, partly cut away, of a heat exchanger module.
Figure 2:
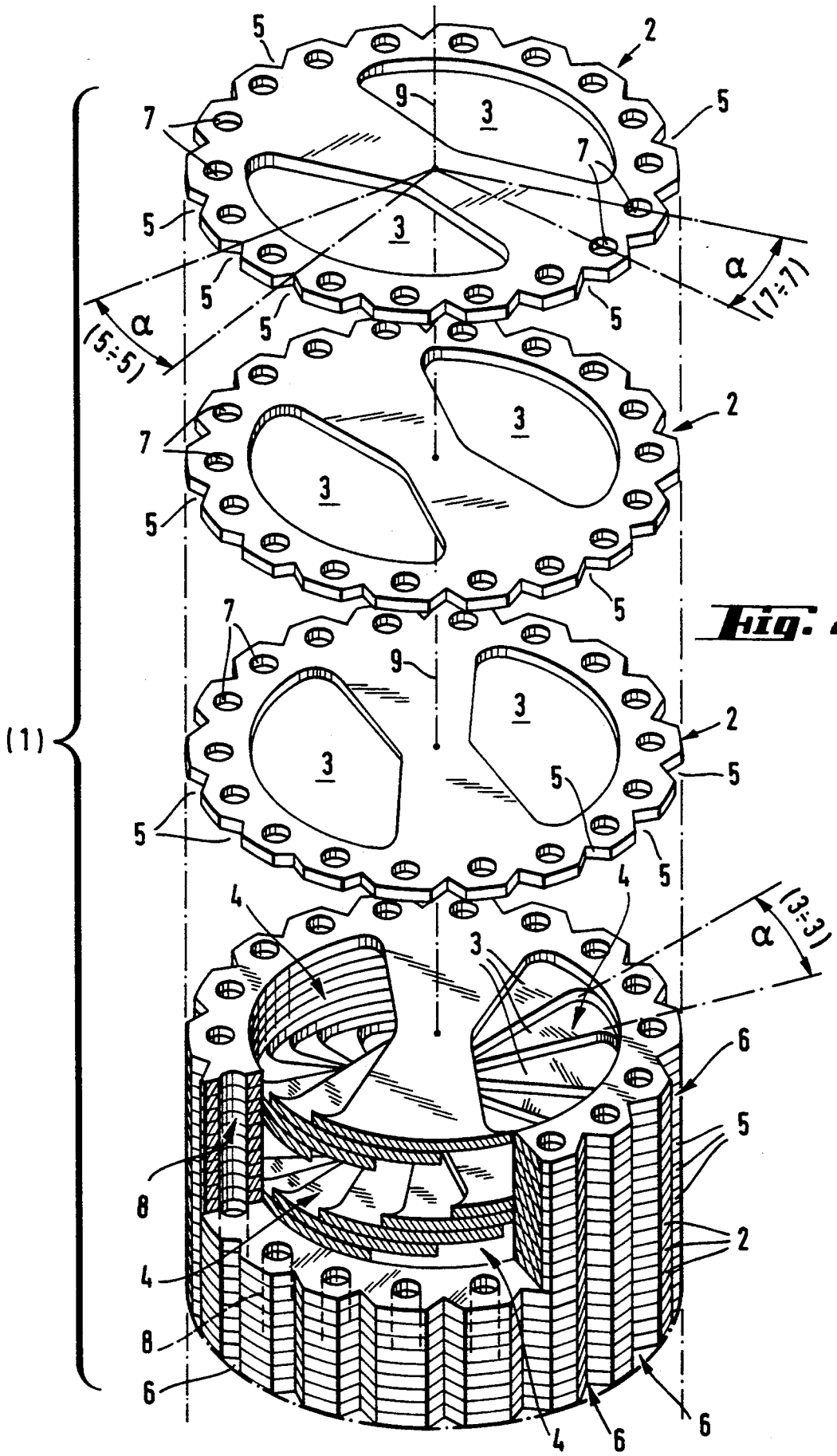
FIG. 2 shows a three-dimensional view, partly exploded and cut away, of the stacking of the green sheet cards forming the heat exchanger module.

The heat-exchanger module 1 without connection dome is produced in particular from green ceramic sheet cards 2. The sheet cards 2 have semicircular openings 3 which are arranged symmetrically to one another and concentrically to the circular contour of the sheet card 2. The sheet cards 2 are placed individually one on top of the other at an angle $\alpha$, for example 20°, with respect to the preceding card, forming helical (spiral staircase-like) channels 4 (double helix). The individual cards 2 can also be combined to form groups of two or more cards, which in turn are then stacked as described for the individual cards. In the staircase structure of the channels 4 the individual cards 2 or the groups of cards which make up the heat exchanger module 1 can be seen. The sheet cards may also have, within certain limits, any given contour, as can their openings. The contour of the card 2 can be provided with apertures 5 which form continuous grooves 6 on the outer surface of the heat exchanger module when the cards are stacked. Furthermore, in addition to the segment-like openings 3, the card 2, may also have apertures 7 which are likewise offset at an angle $\alpha$ and thereby form continuous channels 8 in the module 1. By varying the dimensions of the openings and/or of the angle of rotation $\alpha$, the heat exchanger module can be very flexibly adapted to different requirements. It may also be advantageous to locate the axis of rotation 9 eccentrically. The individual sheet cards 2 are joined by ceramic firing to form a monolithic heat exchanger module or by soldering, welding, adhesion bonding or mechanical joining, for example by means of tie rods with the interposition of seals between the individual cards, to form a heat exchanger module. The cards 2 with the opening 3 can be produced by casting, sawing, milling, turning, deep drawing, stampling, lasers, punching or liquid jet cutting.

We claim:

1. A heat exchanger module produced by stacking sheet cards provided with first openings separated symmetrically by a fin and second openings provided along an outer periphery of the sheet card, and further provided with indexing notches along said periphery of the sheet card, and subsequently joining the individual cards of the card stack, wherein each sheet card or group of sheet cards of the stack is rotated about a common axis by an angle $\alpha$ of between 0° and 30° with respect to the preceding sheet card or group of sheet cards, the first openings forming helical channels and the second openings forming continuous non-helical channels extending longitudinally through the module.

2. The heat exchanger module as claimed in claim 1, wherein the sheet cards are circular in design and have, concentrically to their contour, circular segments as said first openings.

3. The heat exchanger module as claimed in claim 2, wherein the circular sheet cards have two circular segments which are arranged symmetrically to one another and concentrically to the contour of the sheet card as said first openings.

* * * * *